US010669605B2

(12) United States Patent
De Hennis et al.

(10) Patent No.: US 10,669,605 B2
(45) **Date of Patent: *Jun. 2, 2020**

(54) INTERFERENCE FIT QUENCH PLUG ASSEMBLY AND METHODS FOR USE THEREOF

(71) Applicant: THE BOEING COMPANY, Chicago, IL (US)

(72) Inventors: Timothy M. De Hennis, Philadelphia, PA (US); Marco P. Ciccone, Newark, DE (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/209,546

(22) Filed: Dec. 4, 2018

(65) Prior Publication Data

US 2019/0106763 A1 Apr. 11, 2019

Related U.S. Application Data

(62) Division of application No. 14/884,005, filed on Oct. 15, 2015, now Pat. No. 10,174,395.

(51) Int. Cl.

| | |
|---|---|
| ***C21D 9/32*** | (2006.01) |
| ***C21D 1/62*** | (2006.01) |
| ***C21D 6/00*** | (2006.01) |

(52) U.S. Cl.

CPC ..... *C21D 9/32* (2013.01); *C21D 1/62* (2013.01); *C21D 6/00* (2013.01); *C21D 2211/001* (2013.01); *C21D 2211/008* (2013.01)

(58) Field of Classification Search

CPC ..... C21D 1/62

See application file for complete search history.

(56) References Cited

U.S. PATENT DOCUMENTS 1,768,159 A * 6/1930 Shorter ..... C21D 9/32 266/125
1,859,623 A * 5/1932 Gregg ..... C21D 9/34 148/583

(Continued)

FOREIGN PATENT DOCUMENTS

CN 202968640 U * 6/2013
CN 202968640 U 6/2013

OTHER PUBLICATIONS

P.Ya. Kayushnikov, Termicheskaya Obrabotka Metallov, No. 3, pp. 28-33, Mar. 1963 (Year: 1963).

*Primary Examiner* — Colleen P Dunn
*Assistant Examiner* — Sean P. O'Keefe
(74) *Attorney, Agent, or Firm* — The Small Patent Law Group LLC; Joseph M. Butscher

(57) ABSTRACT

A method is provided including heating a workpiece beyond a transformation temperature. The workpiece has at least one internal surface that has a nominal diameter, and a transformation diameter that corresponds to the start of a transformation from a first state to a second state. The method includes inserting a quench plug assembly into the workpiece. The quench plug assembly includes at least one contact surface. The at least one contact surface has a diameter that is larger than the nominal diameter and at least as large as the transformation diameter. The method includes quenching the workpiece with the quench plug assembly disposed in the bore of the workpiece. The at least one internal surface is contacted and restrained by the at least one contact surface while the workpiece transforms from the first state to the second state. Also, the method includes removing the quench plug assembly from the workpiece.

20 Claims, 6 Drawing Sheets

(56) References Cited

U.S. PATENT DOCUMENTS

| | | | | |
|---|---|---|---|---|
| 3,007,823 | A | 11/1961 | Adair et al. | |
| 3,170,975 | A | 2/1965 | Bauer et al. | |
| 4,360,189 | A | 11/1982 | Duncan et al. | |
| 4,523,748 | A | 6/1985 | Latter | |
| 4,844,427 | A | 6/1989 | Pedersen | |
| 5,401,006 | A | 3/1995 | Canner | |
| 5,492,308 | A | 2/1996 | Yao et al. | |
| 8,034,285 | B2 | 10/2011 | Canner | |
| 2012/0060977 | A1* | 3/2012 | Sakaue | C23C 8/04 148/210 |
| 2013/0133784 | A1* | 5/2013 | Kristan | C21D 9/04 148/526 |

* cited by examiner

INTERFERENCE FIT QUENCH PLUG ASSEMBLY AND METHODS FOR USE THEREOF

RELATED APPLICATIONS

This application is a divisional application of U.S. patent application Ser. No. 14/884,005, filed Oct. 15, 2015, entitled "Interference Fit Quench Plug Assembly and Methods for Use Thereof," now U.S. Pat. No. 10,174,395, the entire subject matter of which is incorporated by reference herein.

FIELD OF EMBODIMENTS OF THE DISCLOSURE

Embodiments of the present disclosure generally relate to systems and methods for plugs used during quenching or cooling processes.

BACKGROUND OF THE DISCLOSURE

Various structures may be heat treated (e.g., heated and quenched) to achieve desired metallurgical properties. However, it may be difficult to maintain a workpiece to tight dimensional tolerances during hardening due to distortion of the workpiece under temperature changes, which may be quite rapid during quenching. This distortion may be particularly challenging with thin-walled and or relatively large structures. Press quench processing may alleviate many of these distortion issues. However, press quench equipment is expensive and development of a part specific process (e.g., tooling and parameters) can be time consuming.

SUMMARY OF THE DISCLOSURE

Accordingly, reduction of development time and expense of restraining a structure (such as a rotary actuator for airplane wing control surfaces) during cooling or quenching, are provided in various embodiments disclosed herein. It may be noted that in various embodiments, one or more aspects of the presently disclosed subject matter may be utilized in conjunction with the restraint of other structures during quenching, cooling, or other heat treatment processes.

Certain embodiments of the present disclosure provide a method. The method includes heating a workpiece beyond a transformation temperature. The workpiece has a bore therethrough and at least one internal surface that has a nominal diameter and a transformation diameter. The transformation diameter corresponds to a start of a transformation from a first state to a second state. The method also includes inserting a quench plug assembly into the bore of the workpiece. The quench plug assembly includes at least one contact surface configured to contact and restrain the at least one internal surface of the workpiece during cooling of the workpiece. The at least one contact surface has a diameter at room temperature that is larger than the nominal diameter and at least as large as the transformation diameter. The at least one contact surface provides an interference fit with the at least one internal surface at room temperature. The method further includes quenching the workpiece with the quench plug assembly disposed in the bore of the workpiece. The at least one internal surface is contacted and restrained by the at least one contact surface while the workpiece transforms from the first state to the second state. Also, the method includes removing the quench plug assembly from the workpiece.

Certain embodiments of the present disclosure provide a quench plug assembly. The quench plug assembly is configured to be inserted into a workpiece having a bore therethrough and at least one internal surface. The at least one internal surface has a nominal diameter and a transformation diameter. The transformation diameter corresponds to a start of a transformation from a first state to a second state. The quench plug assembly includes at least one quench plug portion. The at least one quench plug portion includes at least one contact surface configured to contact and restrain the at least one internal surface of the workpiece during cooling of the workpiece. The at least one contact surface has a diameter at room temperature that is larger than the nominal diameter of the workpiece and at least as large as the transformation diameter of the workpiece. The at least one contact surface provides an interference fit with the at least one internal surface at room temperature.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide systems and methods for providing a quench plug used to restrain a workpiece and/or reduce or control distortion during a heat treatment process (e.g., quenching). Various embodiments provide methods of heat treating a cylindrical device using a plug quenching technique and/or a device configured to prevent part deformation during oil quenching. Various embodiments provide precisely manufactured plugs that provide for one or more rigid contact surfaces that prevent, reduce, or minimize part deformation.

Embodiments of the present disclosure relate to details of improved quenching techniques and apparatuses. Reduction of time and/or improvement in quality are accordingly provided as discussed herein.

Figure 1:
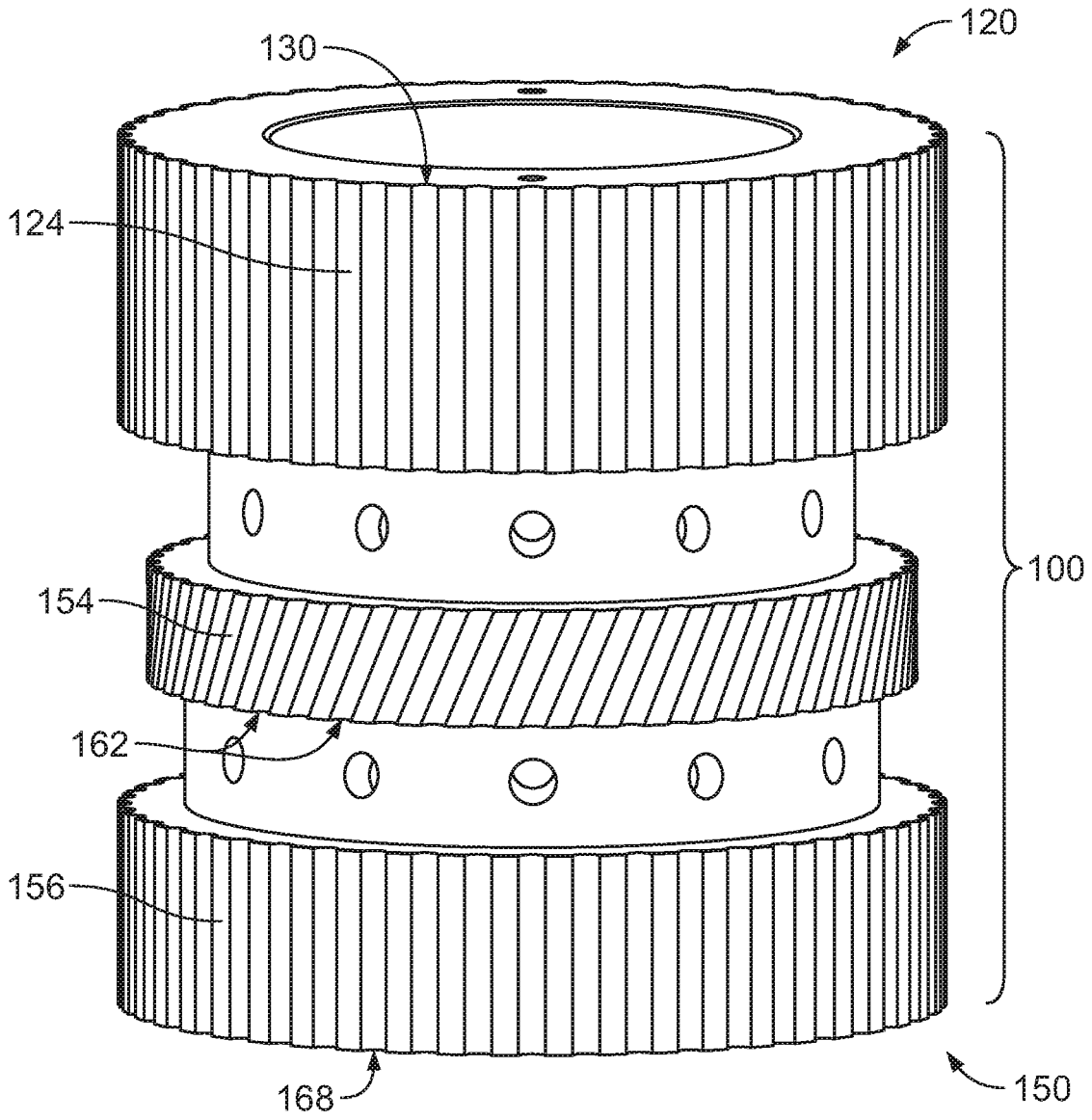
FIG. 1 illustrates a side view of a quench plug assembly, according to an embodiment of the present disclosure.
Figure 2:
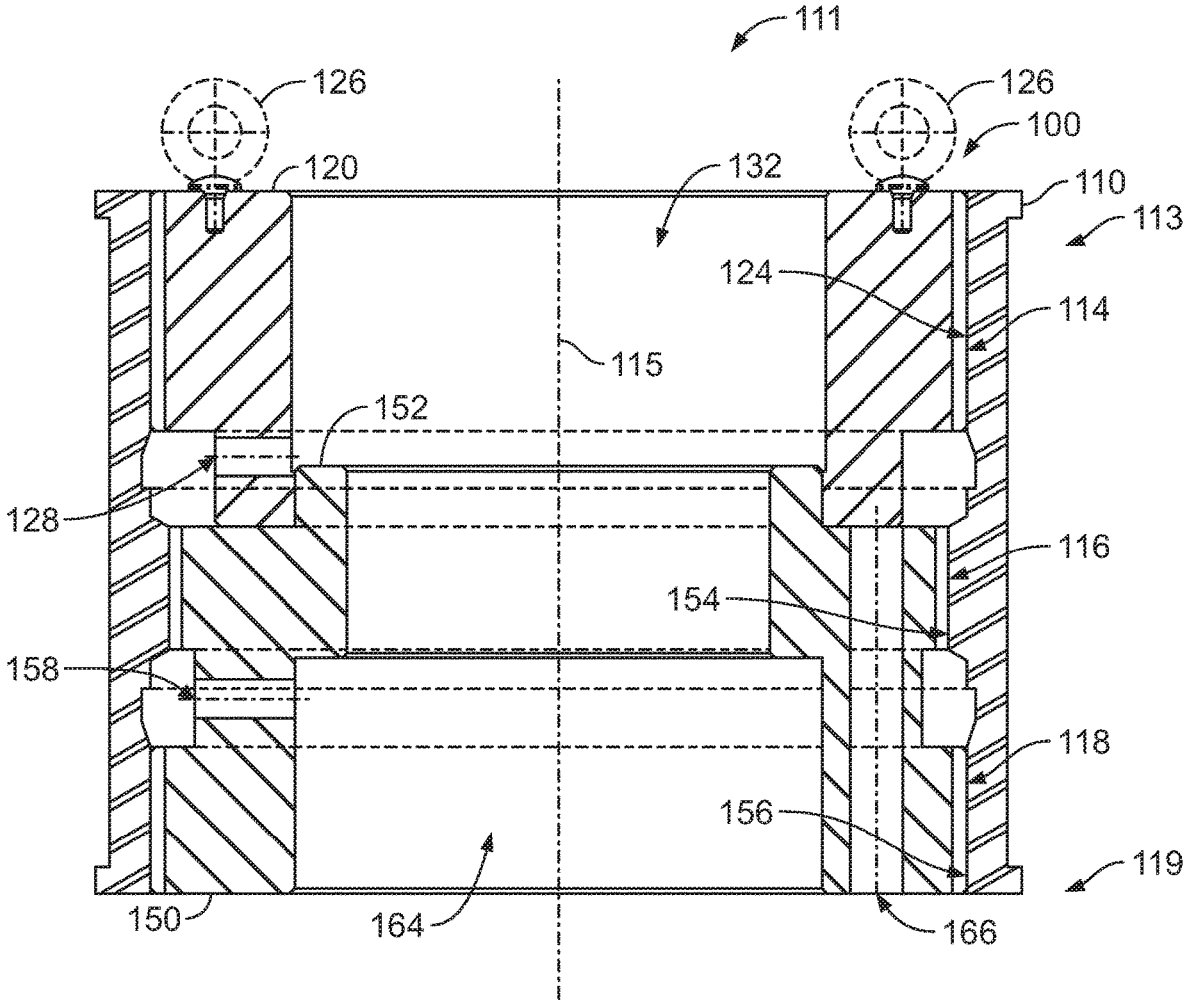
FIG. 2 illustrates a sectional view of the quench plug assembly of FIG. 1 inserted into a workpiece for which the quench plug assembly has been configured.

FIG. 1 illustrates a side view of a quench plug assembly 100, according to an embodiment of the present disclosure, and FIG. 2 illustrates a sectional view of the quench plug assembly 100. As best seen in FIG. 2, the quench plug assembly 100 is configured for use with a workpiece 110. Generally, the workpiece 110 may be heated, for example, as part of a hardening process. The quench plug assembly 100 may be inserted into the workpiece 110 to provide restraint and/or restrict the movement of an internal surface of the workpiece 110 during quenching or other cooling of the workpiece 110 to maintain one or more dimensions of the workpiece 110 within a desired tolerance range.

The workpiece 110 has a bore 111 that extends through the workpiece 110 along an axis 115. The workpiece 110 has a first end 113 and a second end 119 opposite the first end 113. In various embodiments, the workpiece 110 has at least one internal surface. For example, the internal surface may be defined along a diameter centered about the axis 115. In the illustrated embodiment, the workpiece 110 has three internal surfaces, namely a first non-carburized surface 114, a carburized surface 116, and a second non-carburized surface 118. One or more of the internal surfaces may be configured for contact and/or cooperation with an aspect of a mating or corresponding structure. For example, in the illustrated embodiment, the carburized surface 116 is configured as the crest or topland of an internal spur gear. Alternatively or additionally, internal surfaces may be configured for use in conjunction with bearing journals or raceways. The workpiece 110 may be heated and quenched or otherwise cooled as part of a hardening process. During the hardening process, or more specifically the quenching phase of the hardening process, a steel component undergoes a structural transformation, changing from an austenitic to a martensitic crystal structure, which ultimately produces a positive dimensional change and higher hardness in the component. For example, the workpiece 110 may be made of steel, with a nominal diameter at room temperature that grows to a larger diameter at elevated temperatures due to thermal expansion (austenitic diameter). While the workpiece 110 is cooling, the diameter may thermally contract until it reaches the martensitic transformation start point (transformation diameter), then increase to a diameter corresponding to the martensitic transformation finish point (martensitic diameter), and then decrease once again to a final room temperature diameter due to thermal contraction.

Generally, the quench plug assembly 100 includes at least one contact surface that is configured to contact and restrain the at least one internal surface of the workpiece 110 during cooling of the workpiece 110. Prior to hardening, the at least one contact surface of the quench plug assembly 100 has a diameter at room temperature that is larger than the nominal diameter (or room temperature diameter) of the corresponding internal surface of the workpiece 110. Thus, the at least one contact surface may be understood as providing an interference fit with the corresponding internal surface. Also, the room temperature diameter of the at least one contact surface of the quench plug assembly 100 is at least as large as the transformation diameter of the corresponding internal surface of the workpiece 110. Accordingly, as the workpiece 110 cools, the at least one internal surface of the workpiece 110 is contacted by and restrained or impacted by the at least one contact surface of the quench plug assembly 100 during transformation of the workpiece 110 (e.g., from an austenitic state to a martensitic state). Thus, the quench plug assembly 100 is able to control or influence the shape of the workpiece 110 during transformation, in contrast to plugs that are sized at the nominal diameter of a workpiece. The diameter of the at least one contact surface may be selected in various embodiments based on the geometry and material of the workpiece to provide support to the at least one internal surface during transformation that occurs during cooling or quenching, while still being able to be removed (e.g., with a hydraulic press) at or near room temperature. The illustrated quench plug assembly 100 provides a solid structure that has no moving parts, providing for reduced cost and improved ease of use relative to approaches that utilize press quenching.

Figure 3:
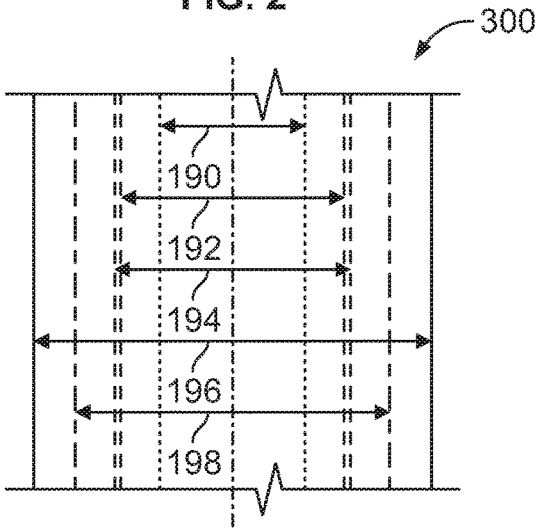
FIG. 3 provides a schematic view of diameters of a workpiece and a quench plug tool, according to an embodiment of the present disclosure.

FIG. 3 provides a schematic view 300 of diameters of a workpiece (e.g., the workpiece 110) and a quench plug tool (e.g., quench plug assembly 100), according to an embodiment of the present disclosure. It may be noted that the particular diameters or distances shown in FIG. 3 are provided by way of example for illustrative purposes, and are not intended to convey actual distances or relative differences between the various diameters, but are instead provided for ease and clarity of illustration. As seen in FIG. 3, the workpiece 110 of the depicted example has a nominal diameter 190 (shown in dotted lines). The nominal diameter 190 is the diameter of the workpiece 110 at room temperature. As seen in FIG. 3, the quench plug tool or assembly has a plug diameter 198 (shown in phantom lines). The plug diameter 198 at room temperature is greater than the nominal diameter 190. Accordingly, with the plug inserted into the workpiece 110, the plug diameter 198 may be understood as providing an interference fit with the workpiece 110, as the plug diameter 198 is larger than the corresponding nominal diameter 190.

As discussed herein, the workpiece 110 may be heated and quenched or cooled as part of a hardening process, for example. As the workpiece 110 is heated, the diameter of the workpiece 110 may increase. In the example depicted in FIG. 3, the workpiece 110 is heated to a first state (e.g., austenitic state) and expands to a first state diameter, or austenitic diameter, 196 (shown in solid lines). The workpiece may then be quenched or cooled. If the workpiece was being free quenched (i.e., quenched without plug tooling) upon cooling the diameter would contract to a transformation diameter 192 (shown in dashed lines). If the workpiece was being free quenched, at the transformation diameter 192, the workpiece 110 begins transformation from the first state to the second state (e.g., from an austenitic state to a martensitic state). As the martensitic transformation progresses, the diameter may increase from the transformation diameter 192 to a second state diameter, or martensitic diameter, 194. However, according to an embodiment of the present disclosure, instead of free quench as described above, the quench plug tool may be inserted into the workpiece when the workpiece reaches the austenitic diameter. As seen in FIG. 3, the plug diameter 198 is greater than the transformation diameter 192. Accordingly, as the workpiece cools, the diameter, instead of contracting to the transformation diameter 192, is restrained by the plug at plug diameter 198. As such, the quench plug tool or assembly 100 may contact the workpiece 110 during an austenitic state to reposition and restrain one or more portions of the workpiece 110 via plastic deformation during the relatively ductile austenitic state even before the transformation temperature is reached.

As best seen in FIG. 2, the quench plug assembly 100 includes three contact surfaces. The quench plug assembly 100 includes a first non-carburized component contact surface 124 that is configured to contact and support the first non-carburized surface 114 of the workpiece 110 during quenching or cooling. The quench plug assembly 100 also includes a carburized component contact surface 154 that is configured to contact and support the carburized surface 116 of the workpiece 110 during quenching or cooling. Further, quench plug assembly 100 includes a second non-carburized component contact surface 156 that is configured to contact and support the second non-carburized surface 118 of the workpiece 110 during quenching or cooling. For example, the carburized component contact surface 154 may contact and restrain a gear, while the first non-carburized component contact surface 124 and second non-carburized component contact surface 156 may contact and restrain diameters on either side of the gear to minimize gear tooth distortion or twisting.

It may be noted that different amounts of interference fit between contact surfaces of the quench plug assembly 100 and internal surfaces of the workpiece 110 may be employed. For example, a first fit between the carburized surface 116 and the carburized component contact surface 154 may have a larger interference than a second fit between the first non-carburized component contact surface 124 and the first non-carburized surface 114 (and/or between the second non-carburized component contact surface 156 and the second non-carburized surface 118). By way of example, the carburized surface 116 may define a diameter on the order of 14.7500 inches, and the carburized component contact surface 154 may have a diameter that provides 0.0016 inches of interference, radially, at room temperature. The non-carburized surfaces (114, 118) may define a diameter on the order of 15.5000 inches, and the non-carburized component contact surfaces (124, 156) may have a diameter that provides 0.0012 inches of interference, radially, at room temperature. Different amounts of interference may be employed for carburized components compared to non-carburized in various embodiments, as carburized components may contract or distort differently with temperature changes. In the example discussed above, a larger amount of interference is utilized in conjunction with the carburized contact surface because there may be more risk of distortion for the carburized portion, and/or the carburized portion may not contract as much as non-carburized portions as the workpiece 110 cools.

It may be noted that, in the illustrated embodiment, the carburized surface 116 is interposed between the non-carburized surfaces, and the diameter for the carburized surface 116 is smaller than the diameter for the non-carburized surfaces. Accordingly, a one-piece plug may not be able to be inserted through the workpiece 110. Accordingly, in the illustrated embodiment, the quench plug assembly includes a first portion 120 and a second portion 150. The first portion 120 is configured to be inserted into the first end 113 of the workpiece 110, and the second portion 150 is configured to be inserted into the second end 119 of the workpiece 110. In the illustrated embodiment, the first portion 120 includes an opening 122 (see FIG. 5) and the second portion includes an extension 152 (see FIG. 7). The opening 122 (see FIG. 5) is configured to accept the extension 152 to mate the first portion 120 and the second portion 150 when the first portion 120 and the second portion 150 are inserted into the workpiece 110.

Figure 4:
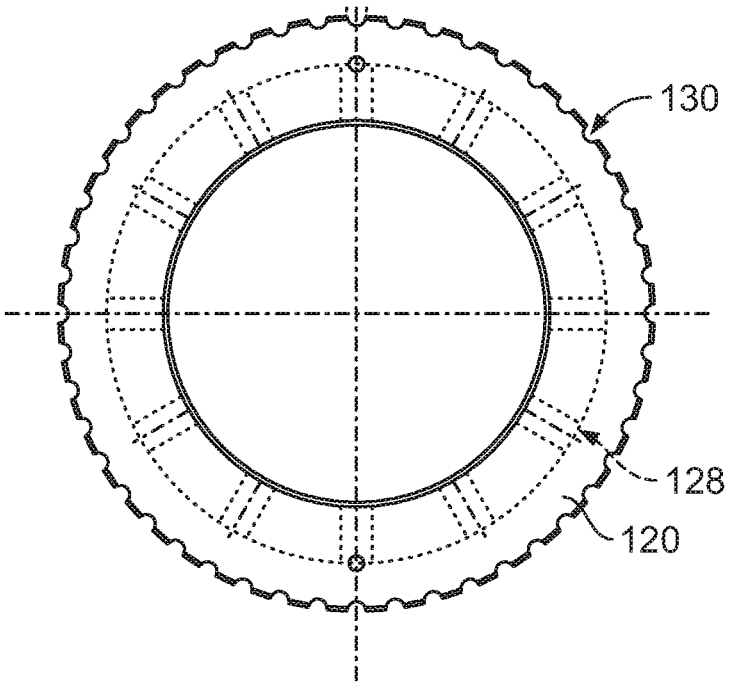
FIG. 4 is an end view of the first portion of the quench plug assembly of FIG. 1.
Figure 5:
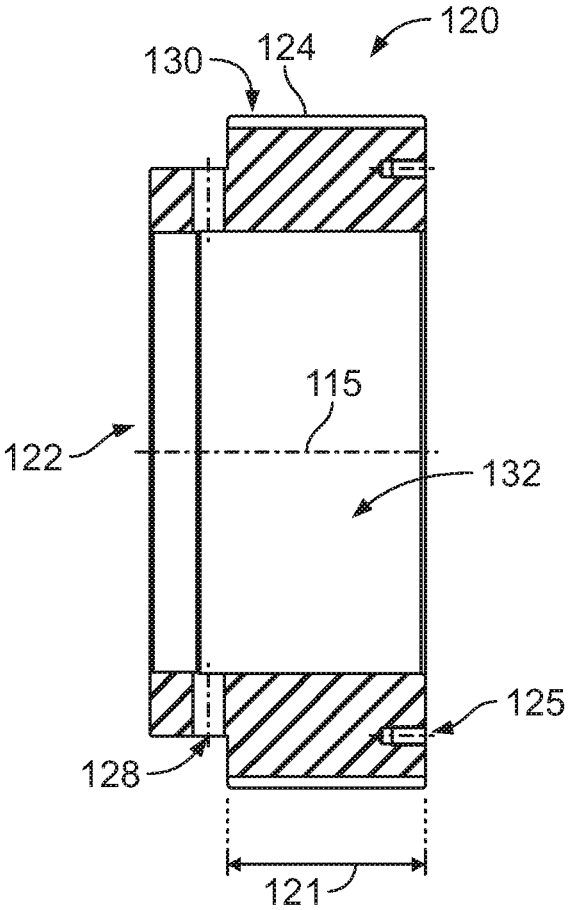
FIG. 5 is a side sectional view of the first portion of the quench plug assembly of FIG. 1.

FIG. 4 is an end view of the first portion 120, and FIG. 5 is a side sectional view of the first portion 120. As best seen in FIGS. 1, 2, 4, and 5, the first portion 120 includes the opening 122 that is configured to accept the extension 152 of the second portion 150. Also, the first portion 120 includes the first non-carburized component contact surface 124. Further, the first portion 120 includes holes 125 configured to accept eye bolts 126. The eye bolts may be utilized to lift or otherwise position the first portion 120 during insertion into the workpiece 110 or removal from the workpiece 110. The first portion 120 further includes oil holes 128. The oil holes 128 extend from the exterior of the first portion 120 to the interior of the first portion 120, and are configured to allow cooling oil (or other fluid) to flow through the first portion 120 during a quenching process. The first portion 120 includes a bore 132 extending therethrough. Generally, the bore 132 may be sized so that the first portion 120 is sufficiently rigid to provide a desired amount of support to the workpiece 110, while reducing the weight of the first portion 120.

It may be noted that the first non-carburized component contact surface 124 in the illustrated embodiment is a tapered surface extending at least along a portion of a length 121 of the first non-carburized component contact surface 124. In the illustrated embodiment, the tapered contact surface 124 extends along the entire length 121 at a constant taper of 0 degrees and 4 minutes. The tapered contact surface 124 provides a maximum diameter at the end of the first portion 120 and tapers inward toward the middle of the first portion 120 to help ease insertion and removal of the first portion 120 from the workpiece 110. Generally, the taper may be sized to help facilitate insertion/removal of the first portion 120 while still maintaining a surface desired to be contacted by the first non-carburized component contact surface 124 within a desired tolerance along the length 121. In addition, the leading edge of surface 124 may include a chamfer or other feature configured to ease insertion or removal of the first portion 120.

Also, in the illustrated embodiment, the first non-carburized component contact surface 124 includes slots 130 extending along at least a portion of the length 121. The slots 130 help facilitate the flow of cooling oil or other fluid during a quenching process. In the illustrated embodiment, the slots 130 are configured as straight slots (or extend generally parallel to the axis 115 along the length 121 of the first non-carburized component contact surface 124). In other embodiments, the slots 130 may be curved or wave-shaped.

Figure 6:
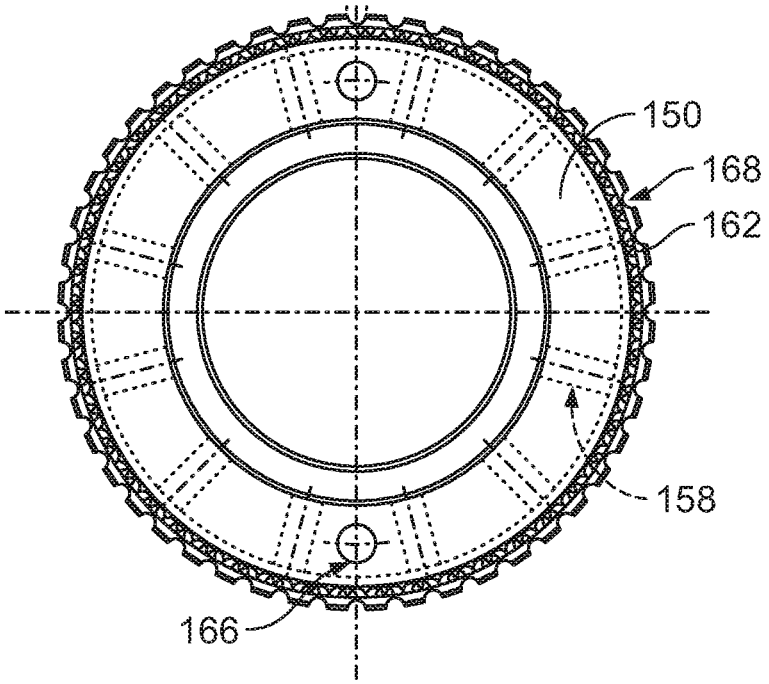
FIG. 6 is an end view of the second portion of the quench plug assembly of FIG. 1.
Figure 7:
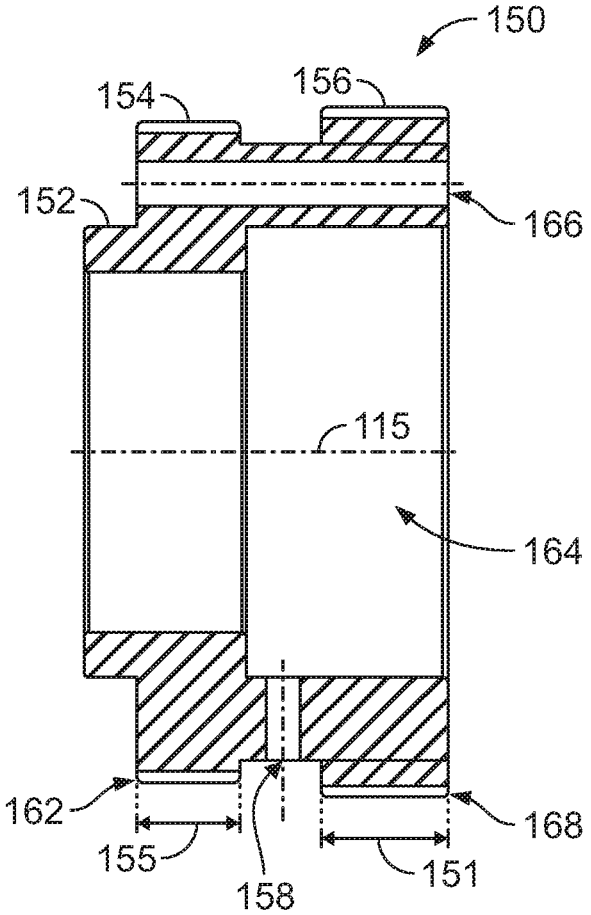
FIG. 7 is a side sectional view of the second portion of the quench plug assembly of FIG. 1.

FIG. 6 is an end view of the second portion 150, and FIG. 7 is a side sectional view of the second portion 150. As best seen in FIGS. 1, 2, 6, and 7, the second portion 150 includes the extension 152 that is configured to be accepted by the opening 122 of the first portion 120. Also, the second portion 120 includes the carburized component contact surface 154 and the second non-carburized component contact surface 156. Also, the second portion 150 further includes oil holes 158. The oil holes 158 extend from the exterior of the second portion 150 to the interior of the second portion 150, and are configured to allow cooling oil (or other fluid) to flow through the second portion 150 during a quenching process. The second portion 150 includes a bore 164 extending therethrough. Generally, the bore 164 may be sized so that the second portion 150 is sufficiently rigid to provide a desired amount of support to the workpiece 110, while reducing the weight of the second portion 150. Further, the second portion 150 includes knockout holes 166 extending in a generally axial direction through the second portion 150. The knockout holes 166 may be used to help separate the first portion 120 from the second portion 150 and/or to remove the second portion 150 from the workpiece. For example, a knockout bar or other tool may be inserted into one of the knockout holes 166 to help separate the second portion 150 from the first portion 120.

It may be noted that the second non-carburized component contact surface 156 in the illustrated embodiment is a tapered surface that extends at least along a portion of a length 151 of the second non-carburized component contact surface 156. In the illustrated embodiment, the tapered contact surface 156 extends along the entire length 151 at a constant taper of 0 degrees and 4 minutes. The tapered contact surface 156 provides a maximum diameter at the end of the second portion 150 and tapers inward toward the middle of the second portion 150 to help ease insertion and removal of the second portion 150 from the workpiece 110. Generally, the taper may be sized to help facilitate insertion/removal of the second portion 150 while still maintaining a surface desired to be contacted by the second non-carburized component contact surface 156 within a desired tolerance along the length 151. In some embodiments, the second non-carburized component contact surface 156 may include a tapered surface while the carburized component contact surface 154 may not. In addition, the leading edge of each contact surface, 154 and 156, may include a chamfer or other feature configured to ease insertion or removal of the second portion 150.

Similar to the first non-carburized component contact surface 124, the second non-carburized component contact surface 156 includes slots 168 extending along at least a portion of the length 151. The slots 168 help facilitate the flow of cooling oil or other fluid during a quenching process. The depicted slots 168 are configured as straight slots (or extend generally parallel to the axis 115 along the length 151 of the second non-carburized component contact surface 156). Alternatively, the slots 168 may be curved or wave-shaped.

Also, the carburized component contact surface 154 includes slots 162 extending along at least a portion of a length 155 of the carburized component contact surface 154. The slots 162 help facilitate the flow of cooling oil or other fluid during a quenching process. The slots 162 are configured as angled slots (or extend at a non-perpendicular angle to a plane that is normal to the axis 115 along the length 155, or are non-parallel to the axis 115) (see, e.g., FIG. 1). The use of angled slots helps ensure that at least a portion of a tip of each gear tooth will be in contact with the carburized component contact surface, and to prevent the complete alignment of a tooth with a slot, which would result in the tooth not being supported by the second portion 150 during quenching. In various embodiments, the slots 162 may be curved or wave-shaped.

Figure 8:
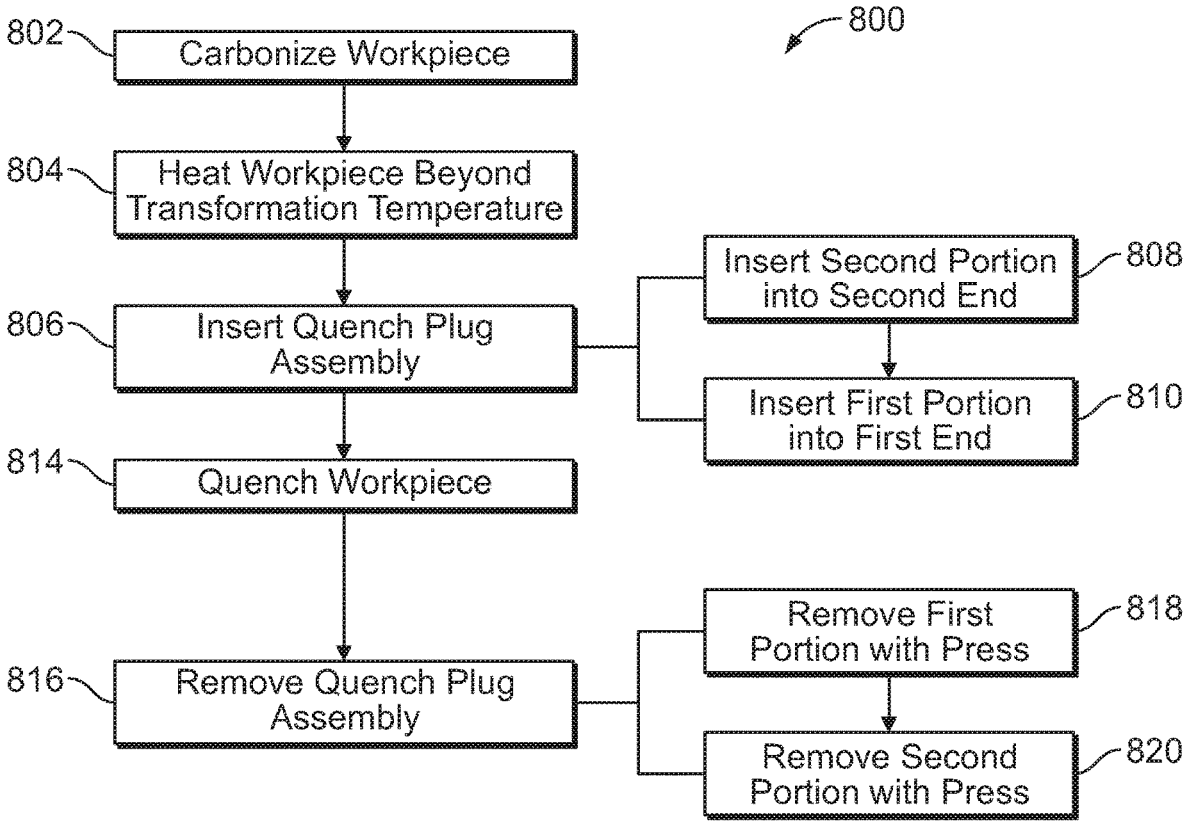
FIG. 8 is a flowchart of a method, according to an embodiment of the present disclosure.

FIG. 8 provides a flowchart of a method 800 for processing (e.g., hardening) a workpiece. The method 800, for example, may employ or be performed by structures or aspects of various embodiments (e.g., systems and/or methods and/or process flows) discussed herein. In various embodiments, certain steps may be omitted or added, certain steps may be combined, certain steps may be performed concurrently, certain steps may be split into multiple steps, certain steps may be performed in a different order, or certain steps or series of steps may be re-performed in an iterative fashion.

At 802, a workpiece (e.g., workpiece 110) is carburized. For example, all or a portion of the workpiece (which, in the illustrated embodiment, is made of steel) may be placed under heat and pressure and infused with carbon. For example, gear teeth of the work piece may be carburized to provide a strong exterior to the teeth while maintaining a relatively ductile interior of the gear teeth. In various embodiments, only a portion of the work piece may be carburized. For example, portions of the workpiece other than the gear teeth may be masked during the carburization process.

At 804, the workpiece is heated beyond a transformation temperature. In the depicted example, the workpiece may be heated beyond a transformation temperature that corresponds to a transformation between austenite and martensite, and maintained at the elevated temperature for a long enough period of time for all or substantially all of the workpiece to enter an austenitic state. The workpiece includes at least one internal surface that has a nominal diameter at room temperature and an austenitic diameter that corresponds to a diameter at elevated temperatures that is larger due to thermal expansion.

At 806, a quench plug assembly (e.g., quench plug assembly 100) is inserted into the workpiece at or near the elevated temperature. The quench plug assembly may be inserted in stages. For example, at 808, a second portion of the quench plug assembly is inserted into the bore of the workpiece via a second end of the workpiece. At 810, a first portion of the quench plug assembly is inserted into a bore of the workpiece via a first end of the workpiece. As the first portion is inserted into the workpiece, an extension of one of the first or second portion is accepted by the other of the first or second portions. It may be noted that the first and/or second portion of the quench plug assembly may include one or more tapered surfaces to help ease insertion of the quench plug assembly into the workpiece and/or removal of the quench plug assembly from the workpiece.

At 814, the workpiece is quenched. It may be noted that the quench plug assembly in the depicted example includes at least one contact surface configured to contact and restrain the at least one internal surface of the workpiece during cooling of the workpiece. The at least one contact surface has a diameter at room temperature that is larger than the nominal diameter of the workpiece, and is at least as large as the transformation diameter of the workpiece. Accordingly, the at least one contact surface provides an interference fit with the at least one internal surface at room temperature. The workpiece may be quenched, for example, by immersion in a cooling fluid such as oil. The quench plug assembly may include holes, slots, and/or other passageways configured to promote the provision of cooling oil to the workpiece (e.g., to internal surfaces of the workpiece). As the workpiece cools to the transformation temperature, the at least one internal surface of the workpiece is contacted by and restrained by the at least one contact surface while the workpiece transforms from the first state to the second state (e.g., from an austenitic state to a martensitic state). The workpiece may also be contacted and restrained by the at least one contact surface in an austenitic state as the workpiece cools toward the transformation temperature. The workpiece, after transformation, may cool further to room temperature.

At 816, with the workpiece cooled, the quench plug assembly is removed from the workpiece. While the diameter of the at least one contact surface is larger than the nominal diameter of the at least one surface of the workpiece, the interference fit is small enough for the quench plug assembly to still be able to be removed from the workpiece. In various embodiments, a press (e.g., hydraulic press) may be used to remove the quench plug assembly from the workpiece. Generally, the diameter of the at least one contact surface is sized to provide a desired amount of support to the workpiece during the quenching, while still providing a small enough interference fit to be removed at room temperature. The quench plug assembly may include one or more tapered surfaces to help facilitate removal of the quench plug assembly from the workpiece. With the quench plug assembly removed from the workpiece, and the workpiece at room temperature, the diameter of the at least one internal surface may contract further. The removal of the quench plug assembly from the workpiece may be accomplished in stages. For example, in the illustrated embodiment, at 818, the second portion of the quench plug assembly is removed with the aid of a press, and, at 820, the first portion of the quench plug assembly is removed with the aid of a press.

Figure 9:
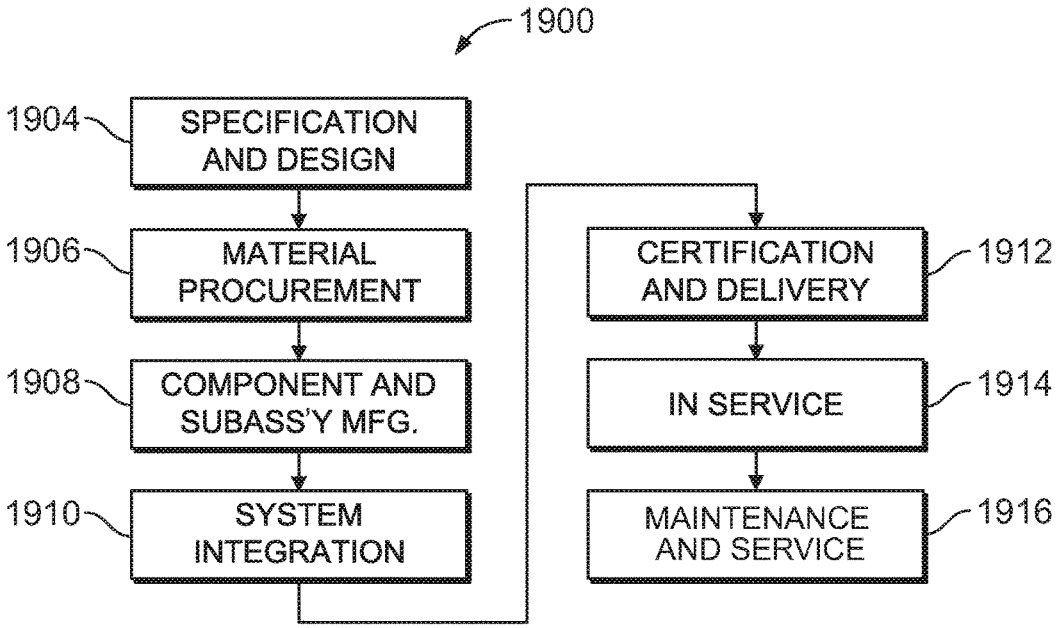
FIG. 9 is a block diagram of aircraft production and service methodology.
Figure 10:
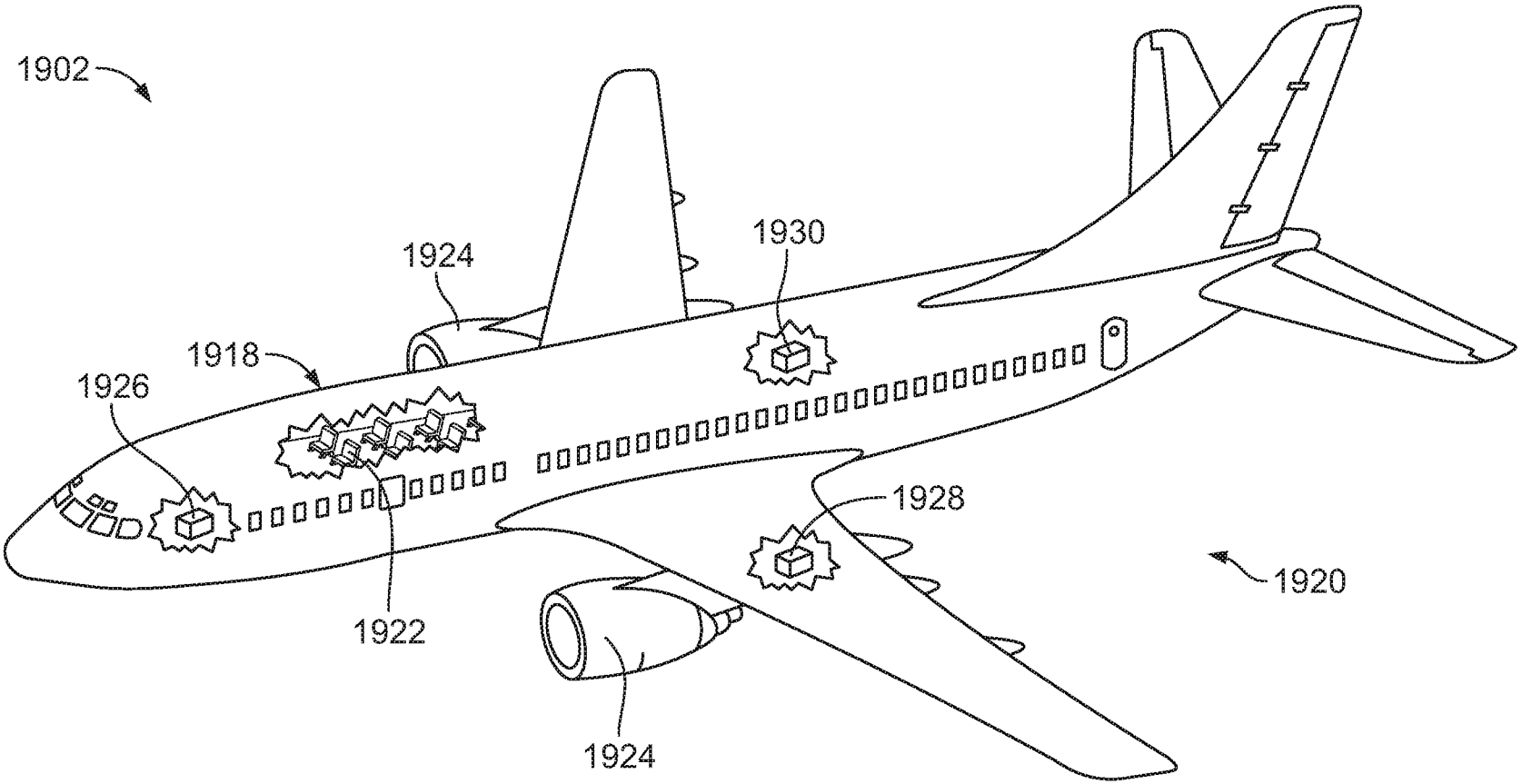
FIG. 10 is a schematic illustration of an aircraft.

Examples of the present disclosure may be described in the context of aircraft manufacturing and service method 1900 as shown in FIG. 9 and aircraft 1902 as shown in FIG. 10. During pre-production, illustrative method 1900 may include specification and design (block 1904) of aircraft 1902 and material procurement (block 1906). During production, component and subassembly manufacturing (block 1908) and system integration (block 1910) of aircraft 1902 may take place. Thereafter, aircraft 1902 may go through certification and delivery (block 1912) to be placed in service (block 1914). While in service, aircraft 1902 may be scheduled for routine maintenance and service (block 1916). Routine maintenance and service may include modification, reconfiguration, refurbishment, etc. of one or more systems of aircraft 1902. For example, in various embodiments, examples of the present disclosure may be used in conjunction with one or more of blocks 1904, 1906, or 1908.

Each of the processes of illustrative method 1900 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 10, aircraft 1902 produced by illustrative method 1900 may include airframe 1918 with a plurality of high-level systems 1920 and interior 1922. Examples of high-level systems 1920 include one or more of propulsion system 1924, electrical system 1926, hydraulic system 1928, and environmental system 1930. Any number of other systems may be included. Although an aerospace example is shown, the principles disclosed herein may be applied to other industries, such as the automotive industry. Accordingly, in addition to aircraft 1902, the principles disclosed herein may apply to other vehicles, e.g., land vehicles, marine vehicles, space vehicles, etc. In various embodiments, examples of the present disclosure may be used in conjunction with one or more of airframe 1918 or interior 1922.

Apparatus(es) and method(s) shown or described herein may be employed during any one or more of the stages of the manufacturing and service method 1900. For example, components or subassemblies corresponding to component and subassembly manufacturing 1908 may be fabricated or manufactured in a manner similar to components or subassemblies produced while aircraft 1902 is in service. Also, one or more examples of the apparatus(es), method(s), or combination thereof may be utilized during production stages 1908 and 1910, for example, by substantially expediting assembly of or reducing the cost of aircraft 1902. Similarly, one or more examples of the apparatus or method realizations, or a combination thereof, may be utilized, for example and without limitation, while aircraft 1902 is in service, e.g., maintenance and service stage (block 1916).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus (es) and method(s) disclosed herein in any combination, and all of such possibilities are intended to be within the spirit and scope of the present disclosure.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A system comprising:

a workpiece having a bore therethrough and at least one internal surface, the at least one internal surface having a nominal diameter and a transformation diameter, the transformation diameter corresponding to a start of a transformation from a first state to a second state, wherein the at least one internal surface of the workpiece comprises a carburized surface and a non-carburized surface; and at least one quench plug portion including at least one contact surface that contacts and restrains the at least one internal surface of the workpiece during cooling of the workpiece, the at least one contact surface of the at least one quench plug portion having a diameter at room temperature that is larger than the nominal diameter of the workpiece and at least as large as the transformation diameter of the workpiece, wherein the at least one contact surface provides an interference fit with the at least one internal surface at room temperature, wherein the at least one contact surface comprises a carburized component contact surface and a non-carburized component contact surface, wherein a first fit between the carburized surface and the carburized component contact surface has a larger interference than a second fit between the at least one non-carburized surface and the non-carburized component contact surface.

2. The system of claim 1, wherein the at least one contact surface comprises slots.

3. The system of claim 2, wherein the slots comprise angled slots configured to contact gear teeth.

4. The system of claim 2, wherein the slots comprise straight slots configured to contact a smooth surface.

5. The system of claim 2, wherein the slots comprise slots that are at least one of curved or wave-shaped.

6. The system of claim 1, wherein the at least one quench plug portion comprises a first portion and a second portion, the first portion configured to be inserted into a first end of the workpiece, and the second portion configured to be inserted into a second end of the workpiece.

7. The system of claim 6, wherein the first portion includes an opening configured to accept an extension of the second portion.

8. The system of claim 1, wherein the at least one contact surface comprises a tapered surface, the tapered surface tapered along a length of the at least one quench plug portion.

9. The system of claim 1, wherein the at least one quench plug portion comprises a through-hole extending from an interior of the at least one quench plug portion to the at least one contact surface, the through-hole configured to allow the passage of a fluid during quenching.

10. A system comprising:

a workpiece having a bore therethrough and a carburized surface between a first non-carburized surface and a second non-carburized surface, wherein the carburized surface, the first non-carburized surface, and the second non-carburized surface have nominal diameters and transformation diameters, the transformation diameters corresponding to a start of a transformation from a first state to a second state; and at least one quench plug portion including a carburized component contact surface, a first non-carburized component contact surface, and a second non-carburized component contact surface that contact and restrain the carburized surface, the first non-carburized surface, and the second non-carburized surface, respectively, during cooling of the workpiece, wherein the carburized component contact surface, the first non-carburized component contact surface, and the second non-carburized component contact surface have diameters at room temperature that are larger than the nominal diameters of the carburized surface, the first non-carburized surface, and the second non-carburized surface, respectively and at least as large as the transformation diameters of the carburized surface, the first non-carburized surface, and the second non-carburized surface, respectively, wherein the carburized component contact surface, the first non-carburized component contact surface, and the second non-carburized component contact surface provide an interference fit with the carburized surface, the first non-carburized surface, and the second non-carburized surface, respectively, at room temperature, wherein a first fit between the carburized surface and the carburized component contact surface has a larger interference than both of a second fit between the first non-carburized surface and the first non-carburized component contact surface, and a third fit between the second non-carburized surface and the second non-carburized component contact surface.

11. The system of claim 10, wherein one or more of the carburized component contact surface, the first non-carburized component contact surface, or the second non-carburized component contact surface comprises slots.

12. The system of claim 11, wherein the slots comprise angled slots configured to contact gear teeth.

13. The system of claim 11, wherein the slots comprise straight slots configured to contact a smooth surface.

14. The system of claim 11, wherein the slots comprise slots that are at least one of curved or wave-shaped.

15. The system of claim 10, wherein the at least one quench plug portion comprises a first portion and a second portion, the first portion inserted into a first end of the workpiece, and the second portion inserted into a second end of the workpiece.

16. The system of claim 15, wherein the first portion includes an opening configured to accept an extension of the second portion.

17. The system of claim 10, wherein one or more of the carburized component contact surface, the first non-carburized component contact surface, or the second non-carburized component contact surface comprises a tapered surface along a length of the quench plug portion.

18. The system of claim 10, wherein the at least one quench plug portion comprises at least one through-hole extending from an interior of the at least one quench plug portion to one or more of the carburized component contact surface, the first non-carburized component contact surface, or the second non-carburized component contact surface, the at least one through-hole configured to allow the passage of a fluid during quenching.

19. A system comprising:

a workpiece having a bore therethrough and a carburized surface between a first non-carburized surface and a second non-carburized surface, wherein the carburized surface, the first non-carburized surface, and the second non-carburized surface have nominal diameters and transformation diameters, the transformation diameters corresponding to a start of a transformation from a first state to a second state; and at least one quench plug portion including a carburized component contact surface, a first non-carburized component contact surface, and a second non-carburized component contact surface that contact and restrain the carburized surface, the first non-carburized surface, and the second non-carburized surface, respectively, during cooling of the workpiece, the carburized component contact surface, the first non-carburized component contact surface, and the second non-carburized component contact surface having diameters at room temperature that are larger than the nominal diameters of the carburized surface, the first non-carburized surface, and the second non-carburized surface, respectively and at least as large as the transformation diameters of the carburized surface, the first non-carburized surface, and the second non-carburized surface, respectively, wherein the at least one quench plug portion further comprises at least one through-hole extending from an interior of the at least one quench plug portion to one or more of the carburized component contact surface, the first non-carburized component contact surface, or the second non-carburized component contact surface, the at least one through-hole configured to allow the passage of a fluid during quenching wherein one or more of the carburized component contact surface, the first non-carburized component contact surface, or the second non-carburized component contact surface comprises slots, wherein one or more of the carburized component contact surface, the first non-carburized component contact surface, or the second non-carburized component contact surface comprises a tapered surface along a length of the quench plug portion, wherein the carburized component contact surface, the first non-carburized component contact surface, and the second non-carburized component contact surface provide an interference fit with the carburized surface, the first non-carburized surface, and the second non-carburized surface, respectively, at room temperature, and wherein a first fit between the carburized surface and the carburized component contact surface has a larger interference than both of a second fit between the first non-carburized surface and the first non-carburized component contact surface, and a third fit between the second non-carburized surface and the second non-carburized component contact surface.

20. The system of claim 19, wherein the at least one quench plug portion comprises a first portion and a second portion, the first portion inserted into a first end of the workpiece, and the second portion inserted into a second end of the workpiece, wherein the first portion includes an opening configured to accept an extension of the second portion.

* * * * *